United States Patent [19]

Killy

[11] 4,378,879

[45] Apr. 5, 1983

[54] CROWN SUPPORT BEVERAGE CARRIER

[75] Inventor: Earl J. Killy, Monroe, La.

[73] Assignee: Manville Service Corporation, Denver, Colo.

[21] Appl. No.: 231,703

[22] Filed: Feb. 5, 1981

[51] Int. Cl.[3] ..... B65D 85/62

[52] U.S. Cl. ..... 206/158; 206/199; 206/427; 294/87.2; 229/52 BC

[58] Field of Search ..... 206/199, 427, 158, 156, 206/153, 140, 161; 229/52 BC; 294/87.2

[56] References Cited

U.S. PATENT DOCUMENTS

| | | | |
|---|---|---|---|
| 1,968,877 | 8/1934 | Cubberley | 206/140 |
| 2,523,986 | 9/1950 | Foster | 206/156 |
| 3,016,259 | 1/1962 | Lawrence | 294/87.2 |
| 3,097,010 | 7/1963 | Silver | 294/87.2 |
| 3,123,213 | 3/1964 | Kulig | 206/65 |
| 3,410,596 | 11/1968 | Slevin, Jr. | 206/158 |
| 3,442,547 | 5/1969 | Skillen | 294/87.2 |
| 3,606,003 | 9/1971 | Graser | 206/65 E |
| 3,640,563 | 2/1972 | Wood | 294/87.2 |
| 3,860,281 | 1/1975 | Wood | 294/87.2 |
| 3,926,307 | 12/1975 | Klygis | 206/153 |
| 4,180,191 | 12/1979 | Wood | 224/45 BA |
| 4,190,149 | 2/1980 | Oliff et al. | 206/145 |

*Primary Examiner*—William T. Dixson, Jr.
*Attorney, Agent, or Firm*—R. M. Halvorsen; J. D. Lister

[57] ABSTRACT

A crown support beverage carrier of the type designed to firmly retain two bottles within the carrier by holding the bottles in a sun burst bottle neck receiving opening. The carrier comprises an elongated inverted U-shaped upper section having formed therein at least two sun burst bottle neck receiving openings with a pair of side walls being hingedly attached to the inverted U-shaped upper section and a pair of end walls being hingedly attached to the pair of side walls.

5 Claims, 5 Drawing Figures

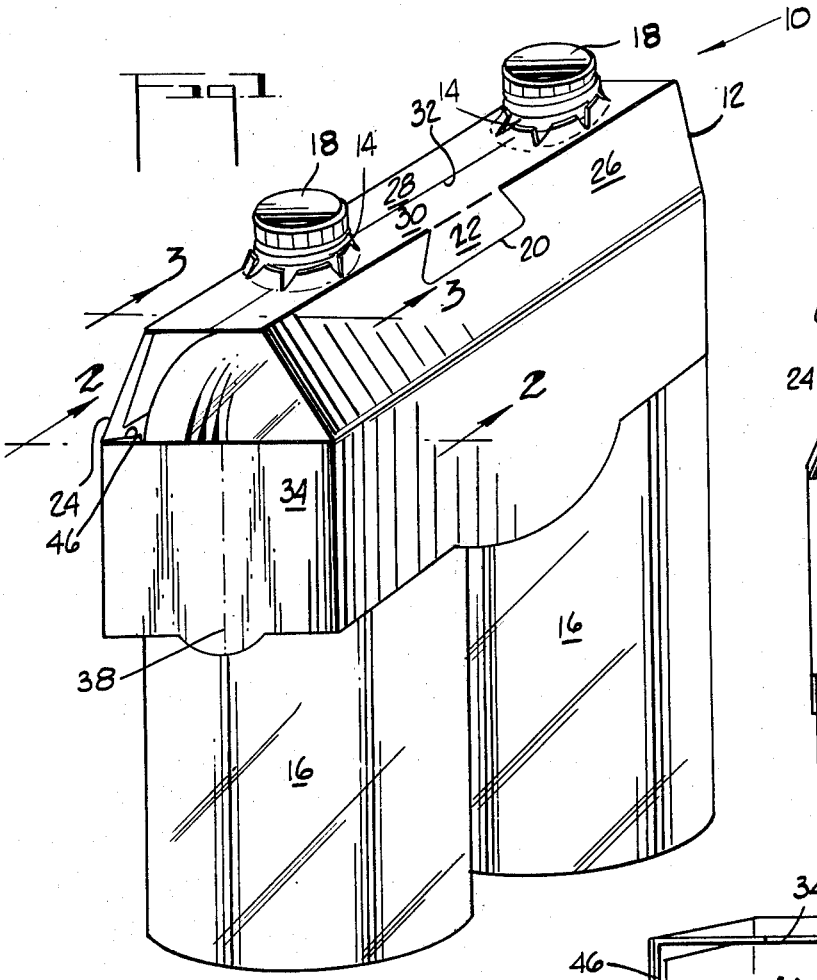
10
18
14
32
12
26
28
30
22
20
3
3
2
2
24
46
34
38
16
16
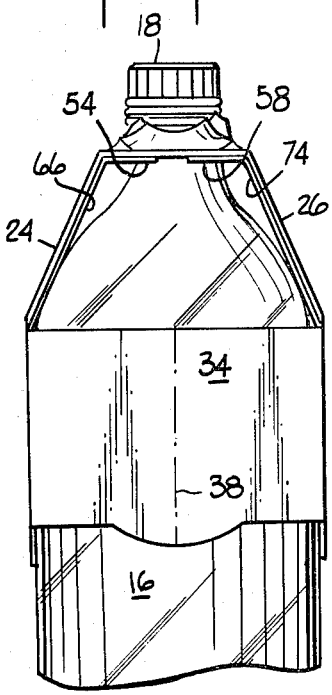
18
54
58
66
74
26
24
34
38
16
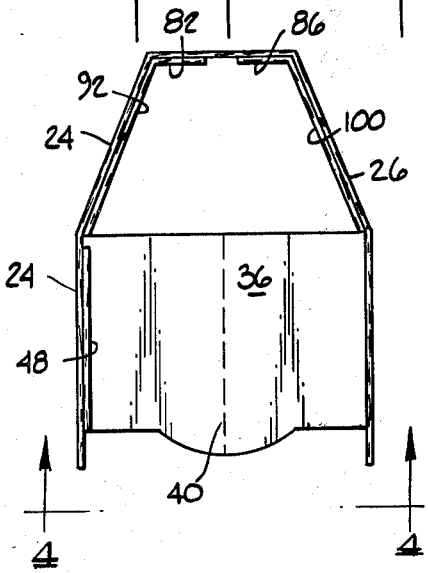
82
86
92
100
24
26
24
36
48
40
4
4
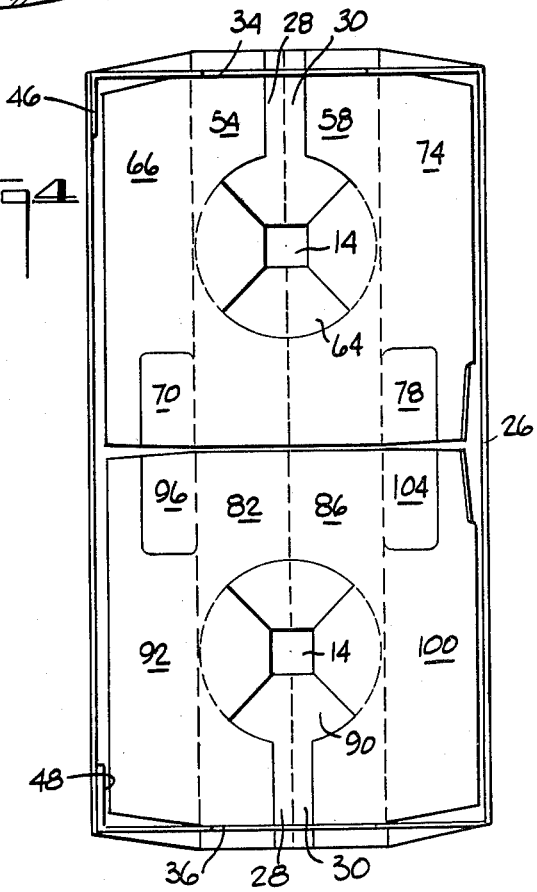
34
28
30
46
54
58
66
74
14
64
70
78
26
96
82
86
104
92
14
100
90
48
36
28
30

46
50
108
80
76
62
72
78
70
68
34
74
64
66
38
58
54
56
60
42
14
20
32
20
26
22
30
28
22
24
14
88
84
44
86
82
40
100
92
36
90
104
96
52
48
110
106
102
94
98

CROWN SUPPORT BEVERAGE CARRIER

BACKGROUND OF THE INVENTION

This invention relates to crown support beverage carriers in general and in particular to a new and improved crown support beverage carrier of the type designed to handle at least two 2-liter type bottles and wherein the carrier has improved graphic space and improved rigidity over present crown support type carriers.

It is known in the prior art to construct crown support carriers having a plurality of openings through which the necks of the bottles contained in the carrier are positioned. The bottle caps are received generally along locking edges which lock the bottle in the carrier until forceably removed by the user of the package.

One typical type of carrier such as this is shown in the U.S. Pat. No. 3,016,259, issued to F. D. Lawrence on Jan. 9, 1962 wherein the carrier is formed in the general shape of a truncated pyramid and has circular neck receiving openings along a bottom surface of the carrier positioned below neck receiving openings formed on the top surface of the carrier. In carriers such as this and other similar carriers limited amounts of advertising material may be placed on the carrier proper. In addition these type prior art carriers do not tend to retain the bottles in the carrier during carrier movement with the exception of the top locking surface. That is to say the bottles many times will be free to move around within the carrier resulting in possible drop-out of the bottles from the carrier proper as a result of the bottle movement.

SUMMARY OF THE INVENTION

In order to overcome the problems inherent in many of the prior art type of carriers herein before described, there has been provided by the Applicant's invention a new and novel crown support carrier which is formed from an elongated inverted U-shaped upper section having formed therein at least two sunburst bottle neck receiving openings for receiving the necks of the beverage bottles having sealing caps applied to the bottles. A downwardly depending pair of side walls in combination with a pair of end walls are hingedly attached to the carrier and provide improved graphic space for advertising purposes on the sides and ends of the carrier. In addition the downwardly depending side walls and end walls of the Applicant's carrier extend below the bottle shoulders and around the ends of the bottles giving more rigidity to the carrier with minimal movement of the bottles within the carrier. In the preferred embodiment, the Applicant's new and improved carrier is formed in a one-piece construction and it is within the spirit and scope of the invention that it could be formed in more than one piece by utilization of separate flaps which are glued to the main body of the carrier by known gluing methods.

Accordingly it is an object and advantage of the invention to provide an improved crown support carrier formed in a one-piece construction which has increased graphic space along the sides and ends of the carrier with the graphic space serving as a means for tightly grouping or retaining the bottles in the carrier against sideways movement whenever the carrier is transported by the user to his home.

Yet another object and advantage of the invention is to provide an improved crown support carrier formed from an elongated inverted V-shaped upper section with a double wall construction being formed in the upper section in proximity to the handle area thereby providing a much stronger carrier than has been heretofore developed.

These and other objects and advantages of the invention will become apparent from a review of the description of the preferred embodiment and from a study of the drawings of the preferred embodiment described herein in this specification.

BRIEF DESCRIPTION OF THE DRAWINGS

FIG. 1 is a perspective view of the Applicant's new and improved crown support carrier showing two 2-liter type bottles inserted in the carrier and through the sunburst bottle neck receiving openings;

FIG. 2 is an end view, taken along line 2—2 of FIG. 1 showing in further detail the placement of the bottles in the crown support carrier and showing in further detail the positioning of the sunburst bottle neck receiving openings under the sealing caps of the bottle;

FIG. 3 is a sectional view, taken along line 3—3 of FIG. 1 showing the internal folding of the carrier flaps and showing the carrier erected without having a bottle positioned in the sunburst openings;

FIG. 4 is a bottom view, taken along line 4—4 of FIG. 3 showing in greater detail the folding of the respective panels of the carrier.

DESCRIPTION OF THE PREFERRED EMBODIMENT

Figure 5:
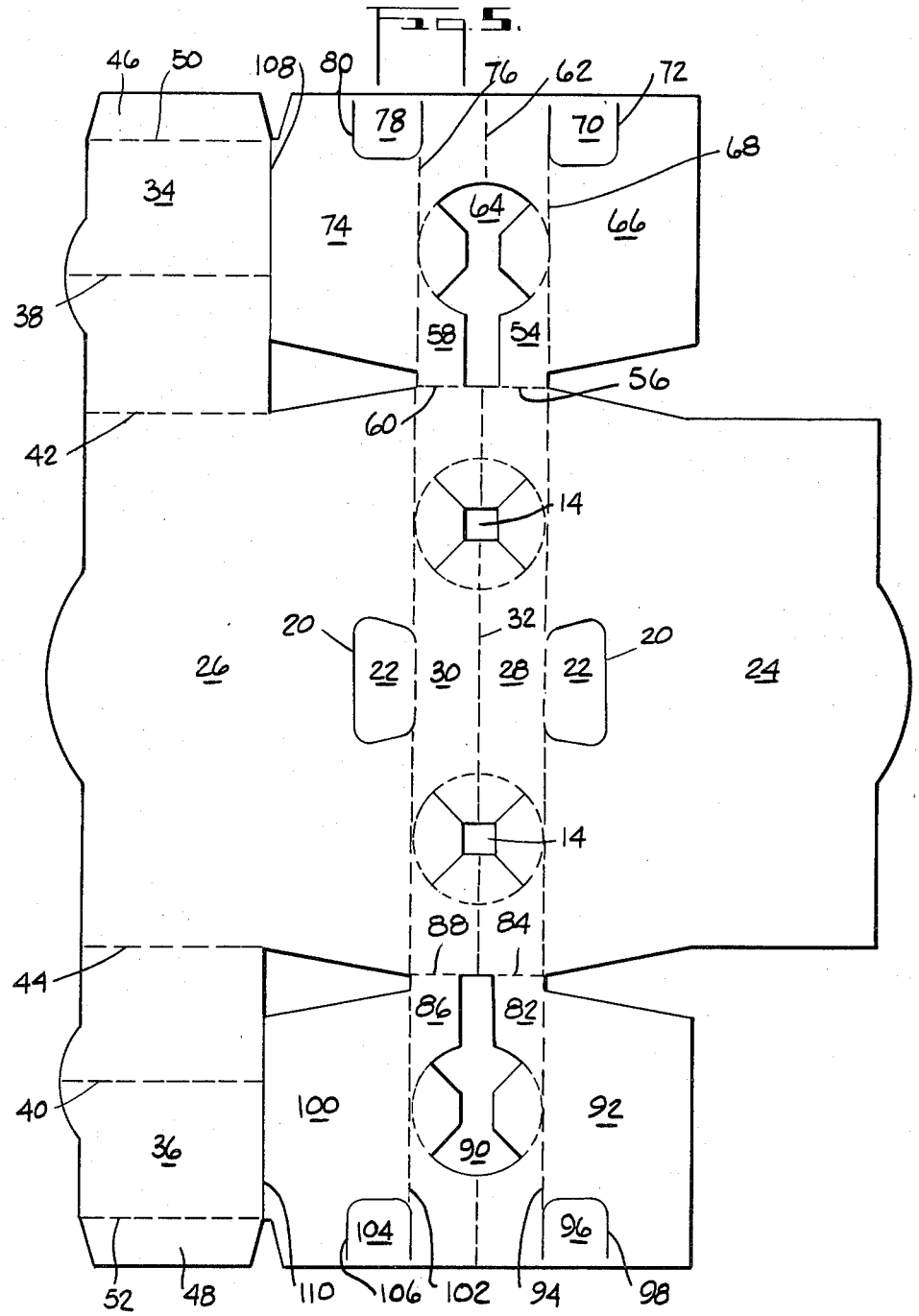
FIG. 5 is a plan view of the one-piece production blank of the preferred embodiment of the Applicant's invention.

Referring now to FIG. 1 of the drawing there is shown the Applicant's new and improved crown support carrier generally by the numeral 10 which comprises a generally elongated inverted U-shaped upper section 12 having formed thereon at least two sunburst bottle neck receiving openings 14 designed for receiving the necks of beverage bottles 16 having sealing caps 18 applied thereto. A handle opening 20 is formed by means of a handle tab 22 die cut from a first side wall panel 24 of the carrier. A second side wall panel 26 is hingedly attached to the other side of the carrier and contains also a handle opening 20 formed from a handle tab 22.

The top surface of the carrier is formed from two outer top wall panels herein described as a first outer top wall panel 28 and a second outer top wall panel 30 which are hingedly attached together by means of the score-line 32.

The second side wall panel 26 has formed on each side thereof an end wall panel herein designated as the first end wall panel 34 and the second end wall panel 36 which have formed thereon glue flaps which will be described hereinafter when referring to FIGS. 4 and 5 of the drawing. The first end wall panel 34 has formed in the central portion thereof a score-line 38 and the second end wall panel 36 has formed in the central portion thereof a score-line 40. The purpose of the score-lines 38 and 40 are to allow the first and second end wall panels 34 and 36 to bow slightly outwardly whenever bottles 16 are inserted into the carrier.

Referring now to FIG. 5 of the drawing there will now be described the production blank of the Applicant's preferred embodiment which will show in greater detail the formation of the internal structure of the carrier providing for a double thickness along the top wall of the carrier as well as the two side panels. As has been before mentioned the second side wall panel 26 is hingedly attached to the second outer top wall panel 30 and has formed thereon a pair of end wall panels herein described as the first end wall panel 34 and the second end wall panel 36. The first end wall panel 34 is hingedly attached to one side of the second side wall panel 26 by means of the score-line 42 while the second end wall panel 36 is hingedly attached to the other side of the second side wall panel 26 by means of the score-line 44. A glue flap 46 and a glue flap 48 are hingedly attached to the end wall panels 34 and 36 respectively by means of the score-lines 50 and 52 as shown in FIG. 5 of the drawing.

The first outer top wall panel 28 has hingedly attached thereto a first inner top wall panel 54 by means of the score-line 56. In a similar manner the second outer top wall panel 30 has hingedly attached thereto a second inner top wall panel 58 by means of the score-line 60. The first inner top wall panel 54 and the second inner top wall panel 58 are also hingedly attached together by means of the score-line 62. The first inner top wall panel 54 and the second inner top wall panel 58 also have formed thereon a sunburst bottle neck receiving opening 64. The first inner top wall panel 54 also has formed thereon a first inner side wall panel 66 hingedly attached thereto by means of the score-line 68 and also has formed thereon a partial handle flap 70 formed by means of the partial die cut 72. In a similar manner the second inner top wall panel 58 has formed thereon a second inner side wall panel 74 hingedly attached thereto by means of the score-line 76 and also has formed thereon a partial handle flap 78 by means of the partial die cut 80.

On the opposite side of the carton there is formed a third inner top wall panel 82 hingedly attached to the first outer top wall panel 28 by means of the score-line 84. In addition there is formed on the other side of the second outer top wall panel 30 a fourth inner top wall panel 86 hingedly attached thereto by means of the score-line 88. The third inner top wall panel 82 and the fourth inner top wall panel 86 have formed thereon a sunburst opening 90 similar to the sunburst opening 64 formed on the opposite side of the carton with both of the sunburst openings 64 and 90 being positioned so as to lie in juxtaposition to the sunburst openings 14 whenever the respective panels are folded about their score-lines 56, 60 and 84, 88.

Hingedly attached to the third inner top wall panel 82 is a third inner side wall panel 92 hingedly attached thereto by means of the score-line 94. The third inner side wall panel 92 also has formed thereon a partial handle flap 96 by means of the partial die cut 98.

In a like manner the fourth inner top wall 86 has hingedly attached thereto a fourth inner side wall panel 100 by means of the score-line 102 and also has formed thereon a partial handle flap 104 by means of the partial die cut 106. The second inner side wall panel 74 is disconnected from the first end wall panel 34 by means of the die cut 108 and in a similar manner the fourth inner side wall panel 100 is disconnected from the second end wall panel 36 by means of the die cut 110. When formed thusly it can be seen that the respective panels 54, 58, 66 and 74 are designed to be folded about the score-lines 56 and 60 to lie in juxtaposition to a portion of the first side wall panel 24 and the second side wall panel 26. In a similar manner it can be seen that the panels 82, 86, 92 and 100 are designed to be folded about the score-lines 84 and 88 to lie in juxtaposition to the remaining portion of the first side wall panel 24 and the second side wall 26. It should also be readily apparent to one skilled in the art that the glue flaps 46 and 48 are then designed to be attached to the respective sides of the first side wall panel 24 whenever the carrier is erected.

Having now completely described the production blank of the Applicant's invention as shown in FIG. 5 there will now be described in more detail FIGS. 2, 3 and 4 of the drawing which show the completed production blank erected in the final position for insertion of the bottles 16 into the crown support carrier 10. FIG. 2 for example shows an end view taken along line 2—2 of FIG. 1 showing how the second end wall panel 36 would be folded and adhesively secured to the first side wall panel 24 and also showing how the third inner side wall panel 92 and the fourth inner side wall panel 100 would be folded and adhesively secured to the underside of the first side wall panel 24 and the second side wall panel 26.

Referring to FIG. 3 of the drawing, there is shown a sectional view taken along line 3—3 of FIG. 1 showing the erected carton with the bottles 16 removed and it can be seen how the second end wall panel 36 is positioned on the end of the carton and is adhesively secured to the first side wall panel 24 by means of the glue flap 48. It can also be seen how the third inner side wall panel 92 is adhesively secured to the first side wall panel 24 and also how the fourth inner side wall panel 100 is adhesively secured to the second side wall panel 26.

Referring now to FIG. 4 of the drawing there is shown a bottom view, taken along line 4—4 of FIG. 3 showing the completely erected carton of the Applicant's invention shown with the respective panels folded and adhesively secured together. The glue flaps 46 and 48 are glued to the first side wall panel 24 as has been before described and also it can be seen from FIG. 4 how the upper portion of the U-shaped upper section 12 is formed of a double thickness paperboard material in the preferred embodiment.

From the foregoing it can be seen there has been provided by the subject invention a new and improved crown support beverage carrier incorporating all of the objects and advantages of the invention. Nevertheless it should become apparent from a review of the description of the preferred embodiment that many changes may be made in the arrangement of the parts of the specific carrier without departing from the spirit and scope of the invention and the particular carrier shown has been shown by way of illustration only.

Having described my invention, I claim:

1. The production blank for a crown support beverage carrier, comprising:

(a) a first side wall panel having formed thereon a handle opening;

(b) a first outer top wall panel hingedly attached to the first side wall panel;

(c) a second outer top wall panel hingedly attached to the first outer top wall panel, the first and second outer top wall panels having formed therein at least two sun burst bottle neck receiving openings;

(d) a second side wall panel hingedly attached to the second outer top wall panel and having formed therein a handle opening;

(e) a first end wall panel hingedly attached to one side of the second side wall panel and having formed thereon on one side thereof a glue flap;

(f) a second end wall panel hingedly attached to the other side of the second side wall panel and having formed thereon a glue flap on one side thereof;

(g) a first inner top wall panel hingedly attached to one side of the first outer top wall panel;

(h) a second inner top wall panel hingedly attached to one side of the second outer top wall panel and also hingedly attached to the first inner top wall panel, the first inner top wall panel and the second inner top wall panel having formed thereon a sun burst bottle neck receiving opening;

(i) a first inner side wall panel hingedly attached to the first inner top wall panel;

(j) a second inner side wall panel hingedly attached to the second inner top wall panel;

(k) a third inner top wall panel hingedly attached to the other side of the first outer top wall panel;

(l) a fourth inner top wall panel hingedly attached to the other side of the second outer top wall panel, the third inner top wall panel and the fourth inner top wall panel hingedly attached to the outer side of the first outer top wall panel and second outer top wall panel having formed thereon a sun burst bottle neck receiving opening;

(m) a third inner side wall panel hingedly attached to the third inner top wall panel formed on the other side of the first outer top wall panel; and (n) a fourth inner side wall panel hingedly attached to the fourth inner top wall panel hingedly attached to the other side of the second top wall panel.

2. The production blank as defined in claim 1 further comprising the handle opening formed in the first side wall panel and the second side wall panel having formed therein handle tabs.

3. A crown support beverage carrier, comprising:

(a) an elongated generally inverted U-shaped upper section having oppositely spaced downwardly and outwardly inclined side wall panels, the upper section further having open ends and a horizontally disposed top wall, the top wall having formed therein at least two sunburst bottle neck receiving openings for receiving the necks of beverage bottles having sealing caps applied thereto;

(b) a handle opening formed in each side of the oppositely spaced downwardly and outwardly inclined side wall panels;

(c) a pair of vertically positioned side wall panels hingedly attached to the oppositely spaced downwardly and outwardly inclined side wall panels;

(d) a pair of end panels fixedly attached to at least one of the vertically positioned side wall panels; and (e) a second inverted U-shaped upper section being hingedly attached to each side of the top panel, the second upper sections having formed thereon bottle receiving openings.

4. The beverage carrier as defined in claim 3 further comprising the carrier being formed from a one piece production blank.

5. The beverage carrier as defined in claim 3 further comprising the handle openings formed on each side of the oppositely spaced downwardly and outwardly inclined side wall panels having formed thereon handle flaps for positioning inwardly inside the carrier and further comprising the second inverted U-shaped upper sections having formed thereon a plurality of partial handle flaps.

* * * * *